US006047239A

United States Patent [19]

Berger et al.

[11] Patent Number: 6,047,239

[45] Date of Patent: Apr. 4, 2000

[54] FORMATION TESTING APPARATUS AND METHOD

[75] Inventors: Per Erik Berger, Vestre Amoy; Nils Reimers, Stavanger, both of Norway; Don Thornton Macune, Houston, Tex.

[73] Assignee: Baker Hughes Incorporated, Houston, Tex.

[21] Appl. No.: 09/088,208

[22] Filed: Jun. 1, 1998

Related U.S. Application Data

[63] Continuation-in-part of application No. 08/626,747, Mar. 28, 1996, Pat. No. 5,803,186, which is a continuation-in-part of application No. 08/414,558, Mar. 31, 1995, abandoned.

[51] Int. Cl.[7] ..... E21B 49/10

[52] U.S. Cl. ..... 702/9; 702/12

[58] Field of Search ..... 702/9, 16; 175/45, 175/50; 367/25; 307/86

[56] References Cited

U.S. PATENT DOCUMENTS

| | | | |
|---|---|---|---|
| 2,681,567 | 6/1954 | Widess | 73/152.46 |
| 2,978,046 | 4/1961 | True | 175/233 |
| 3,041,875 | 7/1962 | Reesby | 73/152.18 |
| 3,059,695 | 10/1962 | Barry et al. | 166/264 |
| 3,107,729 | 10/1963 | Barry et al. | 166/66 |
| 3,439,740 | 4/1969 | Conover | 166/250 |
| 3,611,799 | 10/1971 | Davis | 73/155 |
| 4,573,532 | 3/1986 | Blake | 166/264 |
| 4,635,717 | 1/1987 | Jageler | 166/264 X |
| 4,733,233 | 3/1988 | Grosso et al. | 340/861 |
| 4,860,580 | 8/1989 | DuRocher | 73/152.26 |
| 4,898,236 | 2/1990 | Sask | 166/65.1 |
| 5,337,821 | 8/1994 | Peterson | 166/205.07 |
| 5,341,100 | 8/1994 | Taylor | 324/341 |
| 5,404,946 | 4/1995 | Hess | 166/187 |
| 5,419,405 | 5/1995 | Patton | 175/27 |
| 5,655,607 | 8/1997 | Mellemstrand et al. | 166/386 |
| 5,678,643 | 10/1997 | Robbins et al. | 175/45 |
| 5,803,186 | 9/1998 | Berger et al. | 175/50 |

FOREIGN PATENT DOCUMENTS 0 697 501 A2 2/1996 European Pat. Off. .

OTHER PUBLICATIONS

Badry, Rob, et al.; *New Wireline Formation Tester Techniques and Applications;* pp. 1–15; Jun. 13, 1993; SPWLA Annual Symposium, Alberta, Canada.

Pop, J. J., et al.; *Vertical Interference Testing With a Wireline–Conveyed Straddle–Packer Tool*; pp. 665–680; Oct. 3, 1993; Paper No. SPE 26481 presented at 68th Annual Technical Conference and Exhibition of the Society of Petroleum Engineers, Houston, Texas.

Sanford, Larry, et al.; *Can Inflatable Packers Benefit Your Operations*?; pp. 22–25; May 1994; Well Servicing magazine.

Smits, A. R., et al.; *In–Situ Optical Fluid Analysis as an Aid to Wireline Formation Sampling;* pp. 1–11 Oct. 3, 1993; Paper No. SPE 26496 presented at 68th Annual Technical Conference and Exhibition of the Society of Petroleum Engineers, Houston, Texas.

Schlumberger, *Schlumberger's Versatile, Efficient MDT Tool Makes the Complexities of Reservoir Dynamics Understandable*; 10 pages; Aug., 1990; Advertising brochure.

*Primary Examiner*—Christine K. Oda
*Assistant Examiner*—Victor J. Taylor
*Attorney, Agent, or Firm*—Gerald W. Spinks

[57] ABSTRACT

An apparatus and method are disclosed for obtaining samples of pristine formation or formation fluid, using a work string designed for performing other downhole work such as drilling, workover operations, or re-entry operations. An extendable element extends against the formation wall to obtain the pristine formation or fluid sample. While the test tool is in standby condition, the extendable element is withdrawn within the work string, protected by other structure from damage during operation of the work string. The apparatus is used to sense or sample downhole conditions while using a work string, and the measurements or samples taken can be used to adjust working fluid properties without withdrawing the work string from the bore hole. When the extendable element is a packer, the apparatus can be used to prevent a kick from reaching the surface, adjust the density of the drilling fluid, and thereafter continuing use of the work string.

27 Claims, 10 Drawing Sheets

2
s
F
6
4
18
16
10
8
12
14

2
S
F
6
4
16
18
16
10
8
12
14

FORMATION TESTING APPARATUS AND METHOD

CROSS REFERENCE TO RELATED APPLICATIONS

This is a continuation-in-part patent application of U.S. patent application Ser. No. 08/626,747, filed on Mar. 28, 1996, now U.S. Pat. No. 5,803,186 and entitled "Formation Isolation and Testing Apparatus and Method", which was a continuation-in-part of U.S. patent application Ser. No. 08/414,558, filed on Mar. 31, 1995, and entitled "Method and Apparatus for Testing Wells", now abandoned. These applications are fully incorporated herein by reference.

STATEMENT REGARDING FEDERALLY SPONSORED RESEARCH OR DEVELOPMENT

Not Applicable

BACKGROUND OF THE INVENTION

1. Field of the Invention

This invention relates to the testing of underground formations or reservoirs. More particularly, this invention relates to a method and apparatus for isolating a downhole reservoir, and testing the reservoir formation and fluid.

2. Background Information

While drilling a well for commercial development of hydrocarbon reserves, numerous subterranean reservoirs and formations will be encountered. In order to discover information about the formations, such as whether the reservoirs contain hydrocarbons, logging devices have been incorporated into drill strings to evaluate several characteristics of the these reservoirs. Measurement while drilling systems (hereinafter MWD) have been developed which contain resistivity and nuclear logging; devices which can constantly monitor some of these characteristics while drilling is being performed. The MWD systems can generate data which includes hydrocarbon presence, saturation levels, and porosity data. Moreover, telemetry systems have been developed for use with the MWD systems, to transmit the data to the surface. A common telemetry method is the mud-pulsed system, an example of which is found in U.S. Pat. No. 4,733,233. An advantage of an MWD system is the real time analysis of the subterranean reservoirs for further commercial exploitation.

Commercial development of hydrocarbon fields requires significant amounts of capital. Before field development begins, operators desire to have as much data as possible in order to evaluate the reservoir for commercial viability. Despite the advances in data acquisition during drilling, using the MWD systems, it is often necessary to conduct further testing of the hydrocarbon reservoirs in order to obtain additional data. Therefore, after the well has been drilled, the hydrocarbon zones are often tested by means of other test equipment.

One type of post-drilling test involves producing fluid from the reservoir, collecting samples, shutting-in the well and allowing the pressure to build-up to a static level. This sequence may be repeated several times at several different reservoirs within a given well bore. This type of test is known as a Pressure Build-up Test. One of the important aspects of the data collected during such a test is the pressure build-up information gathered after drawing the pressure down. From this data, information can be derived as to permeability, and size of the reservoir. Further, actual samples of the reservoir fluid must be obtained, and these samples must be tested to gather Pressure-Volume-Temperature data relevant to the reservoir's hydrocarbon distribution.

In order to perform these important tests, it is currently necessary to retrieve the drill string from the well bore. Thereafter, a different tool, designed for the testing, is run into the well bore. A wireline is often used to lower the test tool into the well bore. The test tool sometimes utilizes packers for isolating the reservoir. Numerous communication devices have been designed which provide for manipulation of the test assembly, or alternatively, provide for data transmission from the test assembly. Some of those designs include signaling from the surface of the Earth with pressure pulses, through the fluid in the well bore, to or from a down hole microprocessor located within, or associated with the test assembly. Alternatively, a wire line can be lowered from the surface, into a landing receptacle located within a test assembly, establishing electrical signal communication between the surface and the test assembly. Regardless of the type of test equipment currently used, and regardless of the type of communication system used, the amount of time and money required for retrieving the drill string and running a second test rig into the hole is significant. Further, if the hole is highly deviated, a wire line can not be used to perform the testing, because the test tool may not enter the hole deep enough to reach the desired formation.

There is also another type of problem, related to down hole pressure conditions, which can occur during drilling. The density of the drilling fluid is calculated to achieve maximum drilling efficiency while maintaining safety, and the density is dependent upon the desired relationship between the weight of the drilling mud column and the downhole pressures which will be encountered. As different formations are penetrated during drilling, the downhole pressures can change significantly. With currently available equipment, there is no way to accurately sense the formation pressure as the drill bit penetrates the formation. The formation pressure could be lower than expected, allowing the lowering of mud density, or the formation pressure could be higher than expected, possibly even resulting in a pressure kick. Consequently, since this information is riot easily available to the operator, the drilling mud may be maintained at too high or too low a density for maximum efficiency and maximum safety.

Therefore, there is a need for a method and apparatus that will allow for the pressure testing and fluid sampling of potential hydrocarbon reservoirs as soon as the bore hole has been drilled into the reservoir, without removal of the drill string. Further, there is a need for a method and apparatus that will allow for adjusting drilling fluid density in response to changes in downhole pressures, to achieve maximum drilling efficiency. Finally, there is a need for a method and apparatus that will allow for blow out prevention downhole, to promote drilling safety.

BRIEF SUMMARY OF THE INVENTION

A formation testing method and a test apparatus are disclosed. The test apparatus is mounted on a work string for use in a well bore filled with fluid. The work string can be a conventional threaded tubular drill string, or coiled tubing. It can be a work string designed for drilling, re-entry work, or workover applications. As required for many of these applications, the work string may be one capable of going into highly deviated holes. or even horizontally. Therefore, in order to be fully useful to accomplish the purposes of the present invention, the work string must be one that is capable of being forced into the hole, rather than being dropped like a wireline. The work string can contain a Measurement While Drilling system and a drill bit, or other operative elements. The formation test apparatus includes at least one expandable packer or other extendable structure that can expand or extend to contact the wall of the well bore; means for moving fluid, such as a pump, for taking in formation fluid; a coring device; and at least one sensor for measuring a characteristic of the fluid. The test apparatus will also contain control means, for controlling the various valves or pumps which are used to control fluid flow. The sensors and other instrumentation and control equipment must be carried by the tool. The tool must have a communication system capable of communicating with the surface, and data can be telemetered to the surface or stored in a downhole memory for later retrieval.

The method involves drilling or re-entering a bore hole and selecting an appropriate underground reservoir. The pressure, or some other characteristic of the fluid in the well bore at the reservoir, can then be measured. The extendable element, such as a packer or test probe, is set against the wall of the bore hole to isolate a portion of the bore hole or at least a portion of the bore hole wall. If two packers are used, this will create an upper annulus, a lower annulus, and an intermediate annulus within the well bore. The intermediate annulus corresponds to the isolated portion of the bore hole, and it is positioned at the reservoir to be tested. Next, the pressure, or other property, within the intermediate annulus is measured. The well bore fluid, primarily drilling mud, may then be withdrawn from the intermediate annulus with the pump. The level at which pressure within the intermediate annulus stabilizes may then be measured; it will correspond to the formation pressure. Pressure can also be applied to fracture the formation, or to perform a pressure test of the formation. Additional extendable elements may also be provided, to isolate two or more permeable zones. This allows the pumping of fluid from one or more zones to one or more other zones.

Alternatively, a piston or other test probe can be extended from the test apparatus to contact the bore hole wall in a sealing relationship, or some other expandable element can be extended to create a zone from which essentially pristine formation fluid can be withdrawn. This could also be accomplished by extending a locating arm or rib from one side of the test tool, to force the opposite side of the test tool to contact the bore hole wall, thereby exposing a sample port to the formation fluid. Regardless of the apparatus used, the goal is to establish a zone of pristine formation fluid from which a fluid or core sample can be taken, or in which characteristics of the fluid can be measured. This can be accomplished by various means. The example first mentioned above is to use inflatable packers to isolate a vertical portion of the entire bore hole, subsequently withdrawing drilling fluid from the isolated portion until it fills with formation fluid. The other examples given accomplish the goal by expanding an element against a spot on the bore hole wall, thereby directly contacting the formation and excluding drilling fluid.

Regardless of the apparatus used, it must be constructed so as to be protected during performance of the primary operations for which the work string is intended, such as drilling, re-entry, or workover. If an extendable probe is used, it can retract within the tool, or it can be protected by adjacent stabilizers, or both. A packer or other extendable elastomeric element can retract within a recession in the tool, or it can be protected by a sleeves or some other type of cover.

In addition to the pressure sensor mentioned above, the formation test apparatus can contain a resistivity sensor for measuring the resistivity of the well bore fluid and the formation fluid, or other types of sensors. The restivity of the drilling fluid will be noticeably different from the restivity of the formation fluid. If two packers are used, the restivity of fluid being pumped from the intermediate annulus can be monitored to determine when all of the drilling fluid has been withdrawn from the intermediate annulus. As flow is induced from the isolated formation into the intermediate annulus, the resistivity of the fluid being pumped from the intermediate annulus is monitored. Once the resistivity of the exiting fluid differs sufficiently from the resistivity of the well bore fluid, it is assumed that formation fluid has filled the intermediate annulus, and the flow is terminated. This can also be used to verify a proper seal of the packers, since leaking of drilling fluid past the packers would tend to maintain the restivity at the level of the drilling fluid. Other types of sensors which can be incorporated are flow rate measuring devices, viscosity sensors, density measuring devices, dielectric property measuring devices, and optical spectroscopes.

After shutting, in the formation, the pressure in the intermediate annulus can be monitored. Pumping can also be resumed, to withdraw formation fluid from the intermediate annulus at a measured rate. Pumping of formation fluid and measurement of pressure can be sequenced as desired to provide data which can be used to calculate various properties of the formation, such as permeability and size. If direct contact with the bore hole wall is; used, rather than isolating a vertical section of the bore hole, similar tests can be performed by incorporating test chambers within the test apparatus. The test chambers can be maintained at atmospheric pressure while the work string is being drilled or lowered into the bore hole. Then, when the extendable element has been placed in contact with the formation, exposing a test port to the formation fluid, a test chamber can be selectively placed in fluid communication with the test port. Since the formation fluid will be at much higher pressure than atmospheric, the formation fluid will flow into the test chamber. In this way, several test chambers can be used to perform different pressure tests or take fluid samples.

In some embodiments which use two expandable packers, the formation test apparatus has contained therein a drilling fluid return flow passageway for allowing return flow of the drilling fluid from the lower annulus to the upper annulus. Also included is at least one pump, which can be a venturi pump or any other suitable type of pump, for preventing overpressurization in the intermediate annulus. Overpressurization can be undesirable because of the possible loss of the packer seal, or because it can hamper operation of extendable elements which are operated by differential pressure between the inner bore of the work string and the annulus. To prevent overpressurization, the drilling fluid is pumped down the longitudinal inner bore of the work string, past the lower end of the work string (which is generally the bit), and up the annulus. Then the fluid is channeled through return flow passageway and the venturi pump, creating a low pressure zone at the venturi, so that the fluid within the intermediate annulus is held at a lower pressure than the fluid in the return flow passageway.

The device may also include a circulation valve, for opening and closing the inner bore of the work string. A shunt valve can be located in the work string and operatively associated with the circulation valve, for allowing flow from the inner bore of the work string to the annulus around the work string, when the circulation valve is closed. These valves can be used in operating the test apparatus as a down hole blow-out preventor.

In the case where an influx of reservoir fluids invade the bore hole, which is sometimes referred to as a "kick", the method includes the steps of setting the expandable packers, and then positioning the circulating valve in the closed position. The packers are set at a position that is above the influx zone so that the influx zone is isolated. Next, the shunt valve is placed in the open position. Additives can then be added to the drilling fluid, thereby increasing the density of the mud. The heavier mud is circulated down the work string, through the shunt valve, to fill the annulus. Once the circulation of the denser drilling fluid is completed, the packers can be unseated and the circulation valve can be opened. Drilling may then resume.

An advantage of the present invention includes use of the pressure and resistivity sensors with the MWD system, to allow for real time data transmission of those measurements. Another advantage is that the present invention allows obtaining static pressures, pressure build-ups, and pressure draw-downs with the work string, such as a drill string, in place. Computation of permeability and other reservoir parameters based on the pressure measurements can be accomplished without pulling the drill string.

The packers can be set multiple times, so that testing of several zones is possible. By making measurement of the down hole conditions possible in real time, optimum drilling fluid conditions can be determined which will aid in hole cleaning, drilling safety, and drilling speed. When an influx of reservoir fluid and gas enter the well bore, the high pressure is contained within the lower part of the well bore, significantly reducing risk of being exposed to these pressures at surface. Also, by shutting-in the well bore immediately above the critical zone, the volume of the influx into the well bore is significantly reduced.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
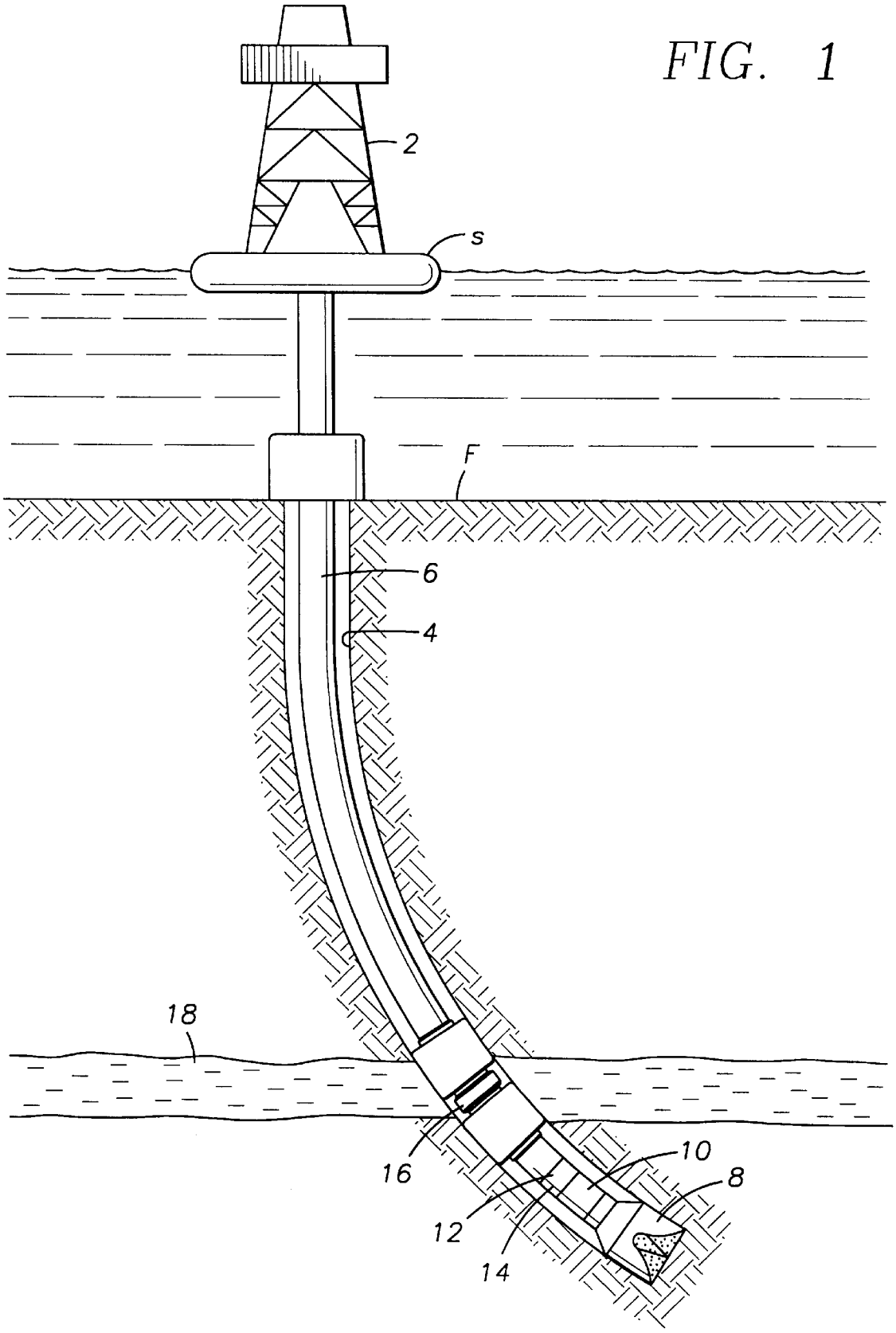
FIG. 1 is a partial section view of the apparatus of the present invention as it would be used with a floating drilling rig.

Referring to FIG. 1, a typical drilling rig 2 with a well bore 4 extending therefrom is illustrated, as is well understood by those of ordinary skill in the art. The drilling rig 2 has a work string 6, which in the embodiment shown is a drill string. The work string 6 has attached thereto a drill bit 8 for drilling the well bore 4. The present invention is also useful in other types of work strings, and it is useful with jointed tubing as well as coiled tubing or other small diameter work string such as snubbing pipe. FIG. 1 depicts the drilling rig 2 positioned on a drill ship S with a riser extending from the drilling ship S to the sea floor F.

If applicable, the work string 6 can have a downhole drill motor 10. Incorporated in the drill string 6 above the drill bit 8 is a mud pulse telemetry system 12, which can incorporate at least one sensor 14, such as a nuclear logging instrument. The sensors 14 sense down hole characteristics of the well bore, the bit, and the reservoir, with such sensors being well known in the art. The bottom hole assembly also contains the formation test apparatus 16 of the present invention, which will be described in greater detail hereinafter. As can be seen, one or more subterranean reservoirs 18 are intersected by the well bore 4.

Figure 2:
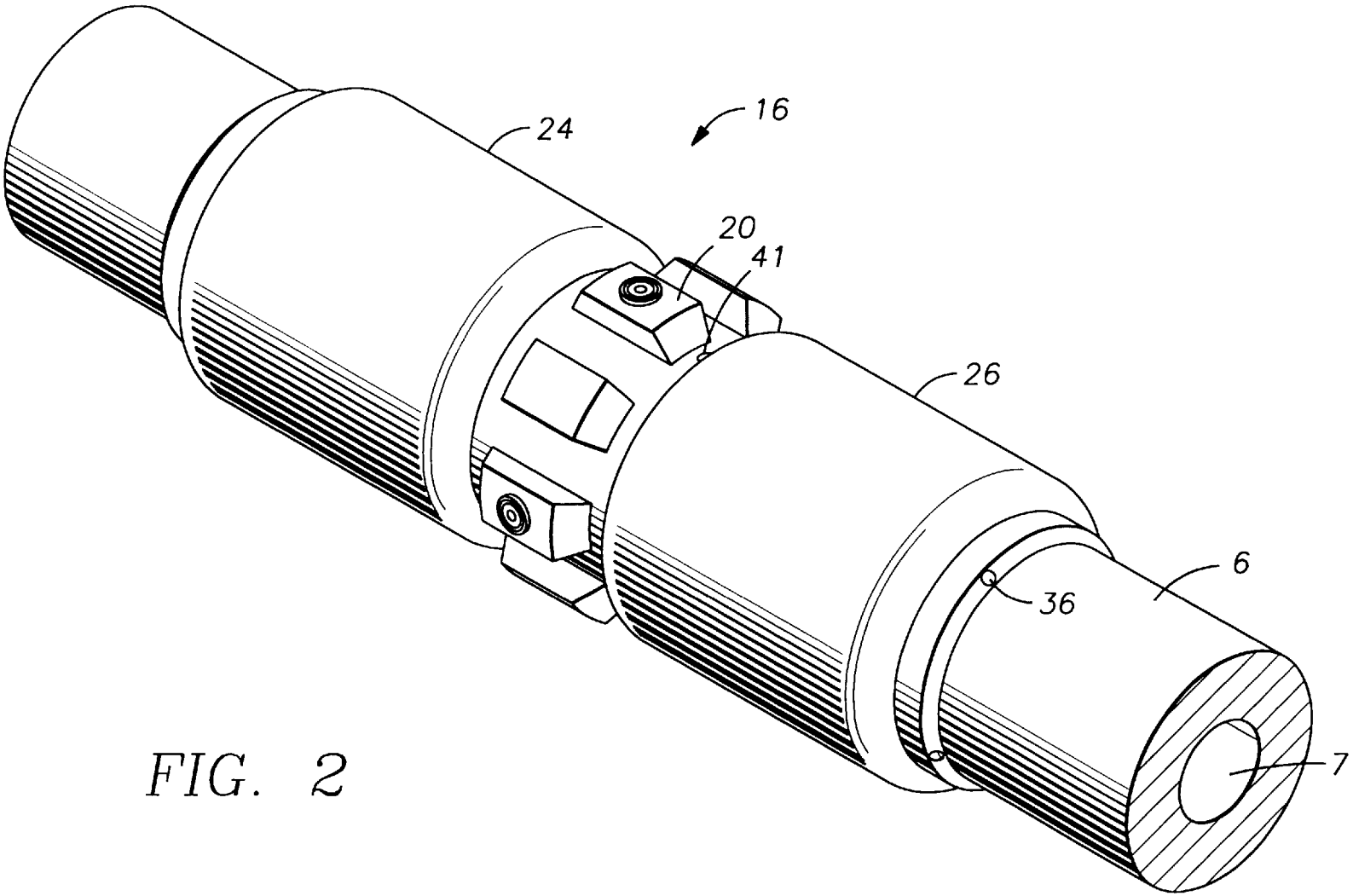
FIG. 2 is a perspective view of one embodiment of the present invention, incorporating expandable packers.

FIG. 2 shows one embodiment of the formation test apparatus 16 in a perspective view, with the expandable packers 24, 26 withdrawn into recesses in the body of the tool. Stabilizer ribs 20 are also shown between the packers 24, 26, arranged around the circumference of the tool, and extending radially outwardly. Also shown are the inlet ports to several drilling fluid return flow passageways 36 and a draw down passageway 41 to be described in more detail below.

Figure 3:
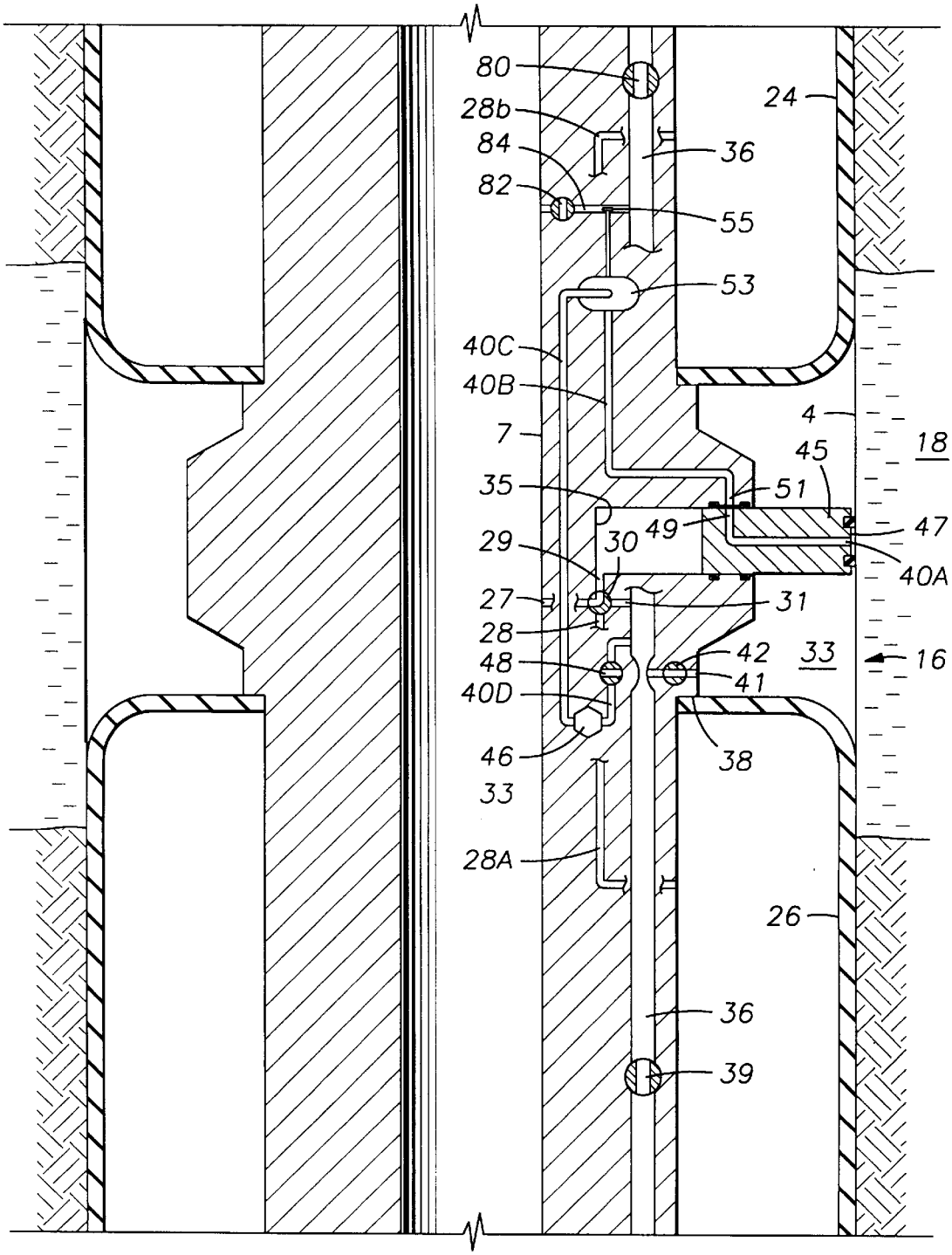
FIG. 3 is a section view of the embodiment of the present invention shown in FIG. 2.

Referring row to FIG. 3, one embodiment of the formation test apparatus 16 is shown positioned adjacent the reservoir 18. The test apparatus 16 contains an upper expandable packer 24 and a lower expandable packer 26 for sealingly engaging the wall of the well bore 4. The packers 24, 26 can be expandable by any means known in the art. Inflatable packer means are well known in the art, with inflation being accomplished by means of injecting a pressurized fluid into the packer. Optional covers for the expandable packer elements may also be included to shield the packer elements from the damaging effects of rotation in the well bore, collision with the wall of the well bore, and other forces encountered during drilling, or other work performed by the work string.

A high pressure drilling fluid passageway 27 is formed between the longitudinal internal bore 7 arid an expansion element control valve 30. An inflation fluid passageway 28 conducts fluid from a first port of the control valve 30 to the packers 24, 26. The inflation fluid passageway 28 branches off into a first branch 28A that is connected to the inflatable packer 26 and a second branch 28B that is connected to the inflatable packer 24. A second port of the control valve 30 is connected to a drive fluid passageway 29, which leads to a cylinder 35 formed within the body of the test tool 16. A third port of the control valve 30 is connected to a low pressure passageway 31, which leads to one of the return flow passageways 36. Alternatively, the low pressure passageway 31 could lead to a venturi pump 38 or to a centrifugal pump 53 which will be discussed further below. The control valve 30 and the other control elements to be discussed are operable by a downhole electronic control system 100 seen in FIG. 11, which will be discussed in greater detail hereinafter.

It can be seen that the control valve 30 can be selectively positioned to pressurize the cylinder 35 or the packers 24, 26 with high pressure drilling fluid flowing in the longitudinal bore 7. This can cause the piston 45 or the packers 24, 26 to extend into contact with the wall of the bore hole 4. Once this extension has been achieved, repositioning the control valve 30 can lock the extended element in place. It can also be seen that the control valve 30 can be selectively positioned to place the cylinder 35 or the packers 24, 26 n fluid communication with a passageway of lower pressure, such as the return flow passageway 36. If spring return means are utilized in the cylinder 35 or the packers 24, 26, as is well known in the art, the piston 45 will retract into the cylinder 35, and the packers 24, 26 will retract within their respective recesses. Alternatively, as will be explained below in the discussion of FIG. 7, the low pressure passageway 31 can be connected to a suction means, such as a pump, to draw the piston 45 within the cylinder 35, or to draw the packers 24, 26 into their recesses.

Once the inflatable packers 24, 26 have been inflated, an upper annulus 32, an intermediate annulus 33, and a lower annulus 34 are formed. This can be more clearly seen in FIG. 5. The inflated packers 24, 26 isolate a portion of the well bore 4 adjacent the reservoir 18 which is to be tested. Once the packers 24, 26 are set against the wall of the well bore 4, an accurate volume within the intermediate annulus 33 may be calculated, which is useful in pressure testing techniques.

The test apparatus 16 also contains at least one fluid sensor system 46 for sensing properties of the various fluids to be encountered. She sensor system 46 can include a resistivity sensor for determining the resistivity of the fluid. Also, a dielectric sensor for sensing the dielectric properties of the fluid, and a pressure sensor for sensing the fluid pressure may be included. Other types of sensors which can be incorporated are flow rate measuring devices, viscosity sensors, density measuring devices, and optical spectroscopes. A series of passageways 40A, 40B, 40C, and 40D are also provided for accomplishing various objectives, such as drawing a pristine formation fluid sample through the piston 45, conducting the fluid to a sensor 46, and returning the fluid to the return flow passageway 36. A sample fluid passageway 40A passes through the piston 45 from its outer face 47 to a side port 49. A sealing element can be provided on the outer face 47 of the piston 45 to ensure that the sample obtained is pristine formation fluid. This in effect isolates a portion of the well bore from the drilling fluid or any other contaminants or pressure sources.

When the piston 45 is extended from the tool, the piston side port 49 can align with a side port 51 in the cylinder 35. A pump inlet passageway 40B connects the cylinder side port 51 to the inlet of a pump 53. The pump 53 can be a centrifugal pump driven by a turbine wheel 55 or by another suitable drive device. The turbine wheel 55 can be driven by flow through a bypass passageway 84 between the longitudinal bore 7 and the return flow passageway 36. Alternatively, the pump 53 can be any other type of suitable pump. A pump outlet passageway 40C is connected between the outlet of the pump 53 and the sensor system 46. A sample fluid return passageway 40D is connected between the sensor 46 and the return flow passageway 36. The passageway 40D has therein a valve 48 for opening and closing the passageway 40D.

Figure 4:
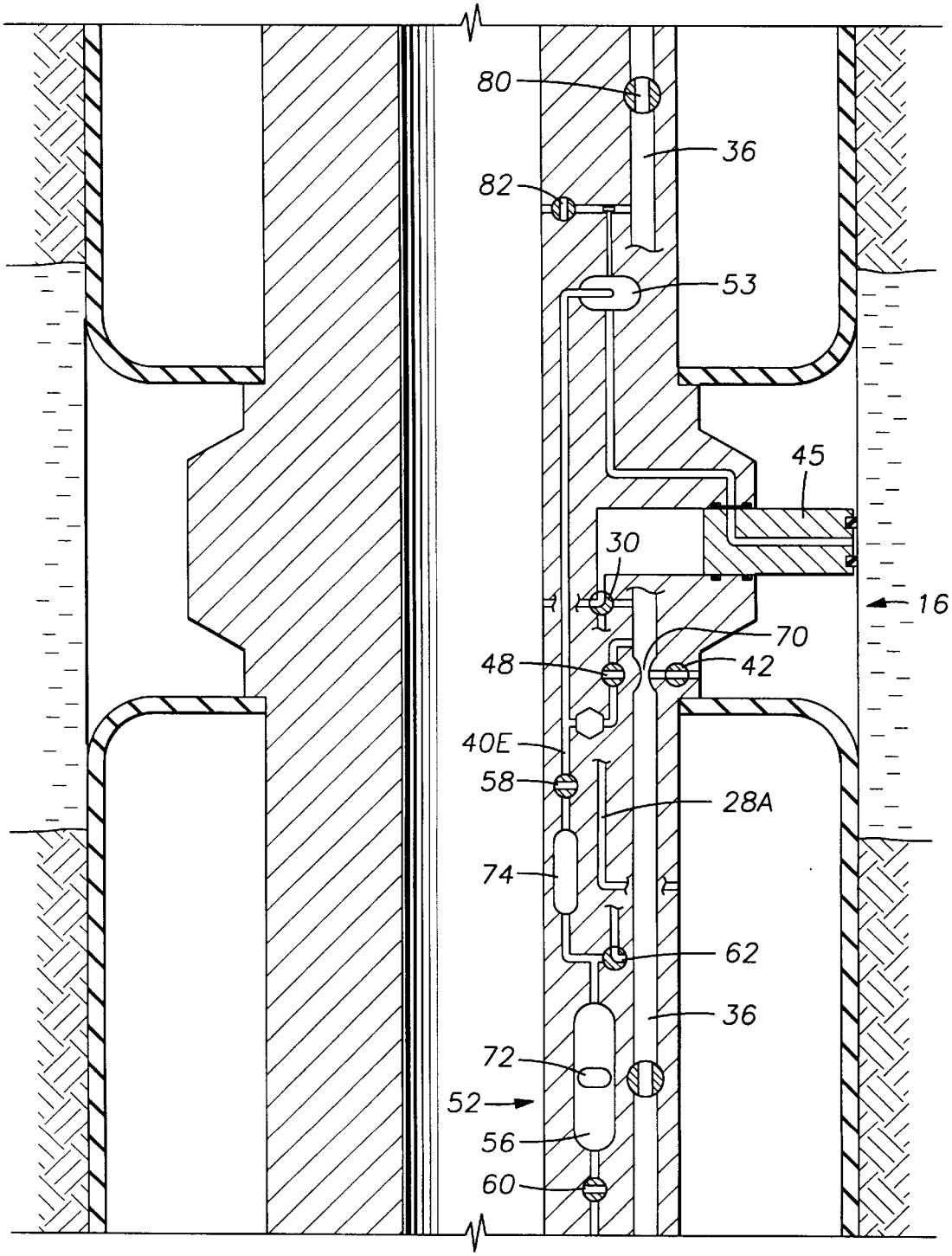
FIG. 4 is a section view of the embodiment shown in FIG. 3, with the addition of a sample chamber.

As seen in FIG. 4, there can be a sample collection passageway 40E which connects the passageways 40A, 40B, 40C, and 40D with the lower sample module, seen generally at 52. The passageway 40E leads to the adjustable choke means 74 and to the sample chamber 56 for collecting a sample. The sample collection passageway 40E has therein a chamber inlet valve 58 for opening and closing the entry into the sample chamber 56. The sample chamber 56 can have a movable baffle 72 for separating the sample fluid from at compressible fluid such as air, to facilitate drawing the sample as will be discussed below. An outlet passage from the sample chamber 56 is also provided, with a chamber outlet valve 62 therein, which can be a manual valve. Also, there is provided a sample expulsion valve 60, which can be a manual valve. The passageways from valves 60 and 62 are connected to external ports (not shown) on the tool. The valves 62 and 60 allow for the removal of the sample fluid once the work string 6 has been pulled from the well bore, as will be discussed below. Alternatively, the sample chamber 56 can be made wireline retrievable, by means well known in the art.

When the packers 24, 26 are inflated, they will seal against the wall of the well bore 4, and as they continue to expand to a firm set, the packers 24, 26 will expand slightly into the intermediate annulus 33. If fluid is trapped within the intermediate annulus 33, this expansion can tend to increase the pressure in the intermediate annulus 33 to a level above the pressure in the lower annulus 34 and the upper annulus 32. For operation of extendable elements such as the piston 45, it is desired to have the pressure in the longitudinal bore 7 of the drill string 6 higher than the pressure in the intermediate annulus 33. Therefore, a venturi pump 38 is used to prevent overpressurization of the intermediate annulus 33.

The drill siring 6 contains several drilling fluid return flow passageways 36 for allowing return flow of the drilling fluid from the lower annulus 34 to the upper annulus 32, when the packers 24, 26 are expanded. A venturi pump 38 is provided within at least one of the return flow passageways 36, and its structure is designed for creating a zone of lower pressure, which can be used to prevent overpressurization in the intermediate annulus 33, via the draw down passageway 41 and the draw down control valve 42. Similarly, the venturi pump 38 could be connected to the low pressure passageway 31, so that the low pressure zone created by the venturi pump 38 could be used to withdraw the piston 45 or the packers 24, 26. Alternatively, as explained below in the discussion of FIG. 7, another type of pump could be used for this purpose.

Figure 5:
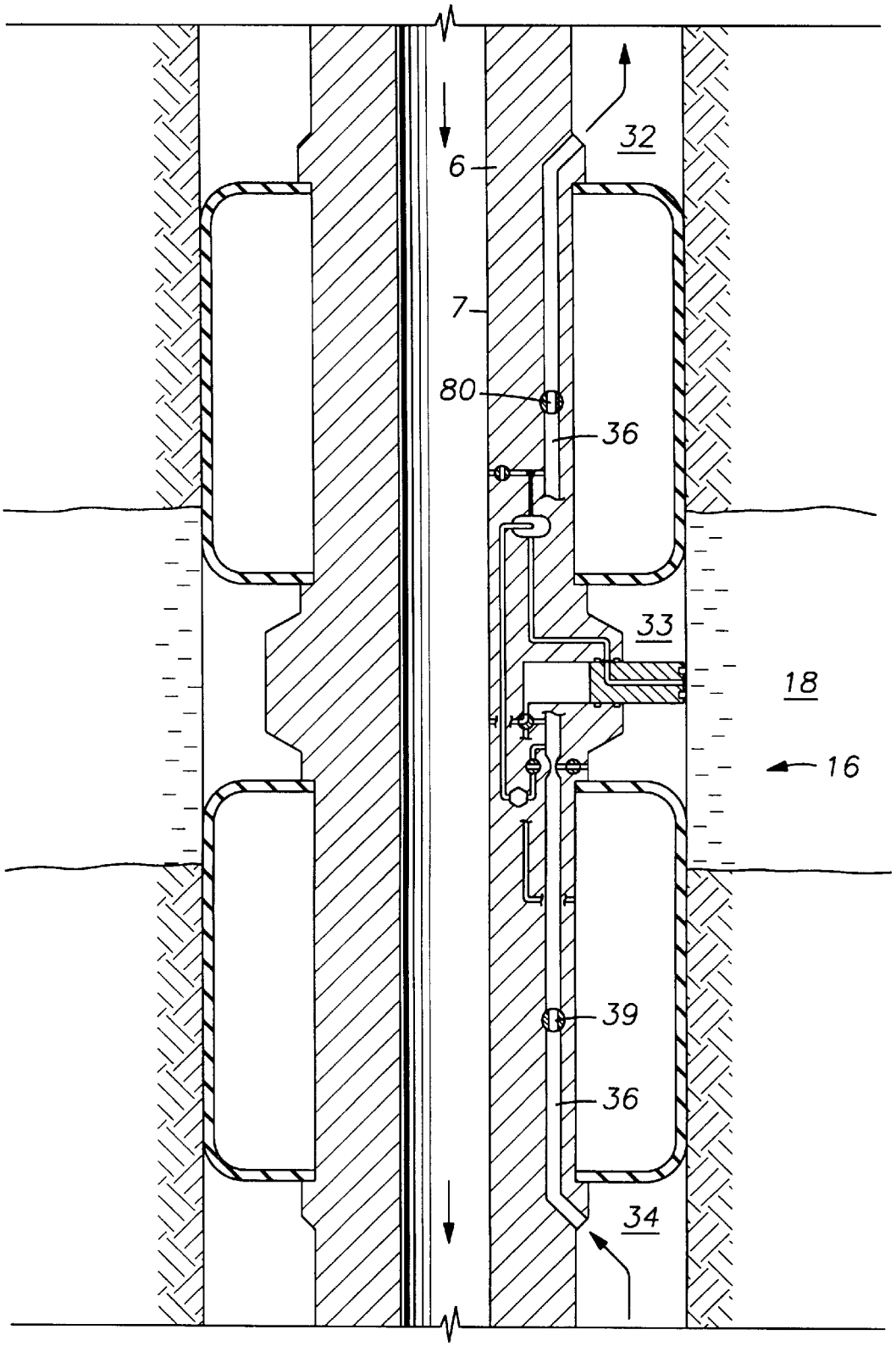
FIG. 5 is a section view of the embodiment shown in FIG. 3, illustrating the flow path of drilling fluid.

Several return flow passageways can be provided, as shown in FIG. 2. One return flow passageway 36 is used to operate the venturi pump 38. As seen in FIG. 3 and FIG. 4, the return flow passageway 36 has a generally constant internal diameter until the venturi restriction 70 is encountered. As shown in FIG. 5, the drilling fluid is pumped down the longitudinal bore 7 of the work string 6, to exit near the lower end of the drill string at the drill bit 8, and to return up the annular space as denoted by the flow arrows. Assuming that the inflatable packers 24, 26 have been set and a seal has been achieved against the well bore 4, then the annular flow will be diverted through the return flow passageways 36. As the flow approaches the venturi restriction 70, a pressure drop occurs such that the venturi effect will cause a low pressure zone in the venturi. This low pressure zone communicates with the intermediate annulus 33 through the draw down passageway 41, preventing any overpressurization of the intermediate annulus 33.

The return flow passageway 36 also contains an inlet valve 39 and an outlet valve 80, for opening and closing the return flow passageway 36, so that the upper annulus 32 can be isolated from the lower annulus 34. The bypass passageway 84 connects the longitudinal bore 7 of the work string 6 to the return flow passageway 36.

Figure 6:
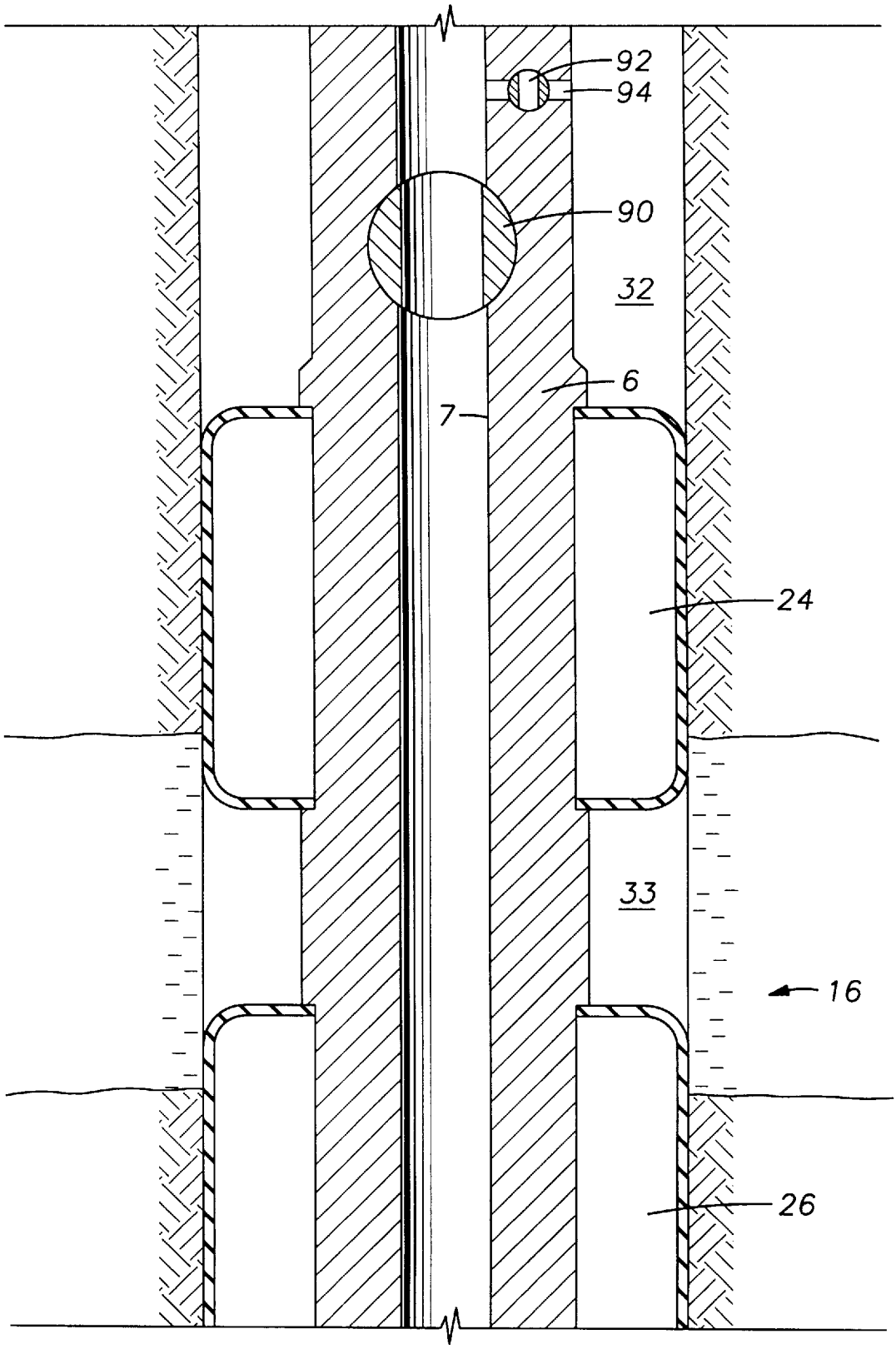
FIG. 6 is a section view of a circulation valve and a shunt valve which can be incorporated into the embodiment shown in FIG. 3.

Referring now to FIG. 6, yet another possible feature of the present invention is shown, wherein the work string 6 has installed therein a circulation valve 90, for opening and closing the inner bore 7 of the work string 6. Also included is a shunt valve 92, located in the shunt passageway 94, for allowing flow from the inner bore 7 of the work string 6 to the upper annulus 32. The remainder of the formation tester is the same as previously described.

The circulation valve 90 and the shunt valve 92 are operatively associated with the control system 100. In order to operate the circulation valve 90, a mud pulse signal is transmitted down hole, thereby signaling the control system 100 to shift the position of the valve 90. The same sequence would be necessary in order to operate the shunt valve 92.

Figure 7:
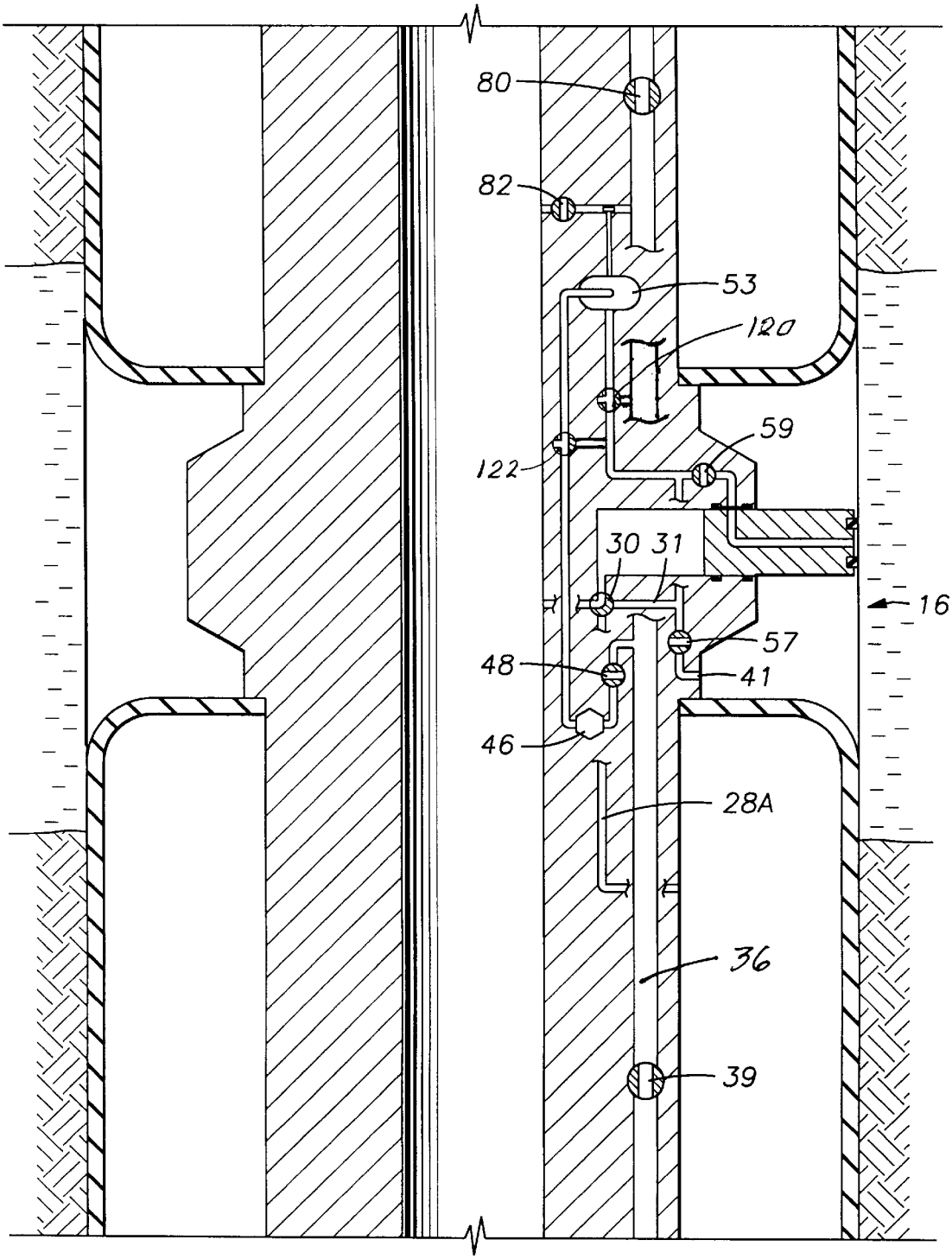
FIG. 7 is a section view of another embodiment of the present invention, showing the use of a centrifugal pump to drain the intermediate annulus.

FIG. 7 illustrates an alternative means of performing the functions performed by the venturi pump 38. The centrifugal pump 53 can have its inlet connected to the draw down passageway 41 and to the low pressure passageway 31. A draw down valve 57 and a sample inlet valve 59 are provided in the pump inlet passageway to the intermediate annulus and the piston, respectively. The pump inlet passageway is also connected to the low pressure side of the control valve 30. This allows use of the pump 53, or another similar pump, to withdraw fluid from the intermediate annulus 33 through valve 57, to withdraw a sample of formation fluid directly from the formation through valve 59, or to pump down the cylinder 35 or the packers 24, 26.

FIG. 7 also shows a means of applying fluid pressure to the formation, either via the intermediate annulus 33 or via the sample inlet valve 59. The purpose of applying this fluid pressure may be either to fracture the formation, or to perform a pressure test of the formation. A pump inlet valve 120 and a pump outlet valve 122 are provided in the inlet and outlet respectively, of the pump 53. The pump inlet valve 120 can be positioned as shown to align the pump inlet with the low pressure passageway 31 as required for the operations described above. Alternatively, the pump inlet valve 120 can be rotated clockwise a quarter turn by the control system 100 to align the pump inlet with the return flow passageway 36. Similarly, the pump outlet valve 122 can be positioned as shown to align the pump outlet with the return flow passageway 36 as required for the operations described above. Alternatively, the pump outlet valve 122 can be rotated clockwise a quarter turn by the control system 100 to align the pump outlet with the low pressure passageway 31. With the pump inlet valve 120 aligned to connect the pump inlet with the return flow passageway 36 and the pump outlet valve 122 aligned to connect the pump outlet with the low pressure passageway 31, the pump 53 can be operated to draw fluid from the return flow passageway 36 to pressurize the formation via the low, pressure passageway 31. Pressurization of the formation can be through the extendable piston 45, with the sample inlet valve 59 open and the draw down valve 57 shut. Alternatively pressurization of the formation can be through the annulus 33, with the sample inlet valve 59 shut and the draw down valve 57 open.

Figure 8:
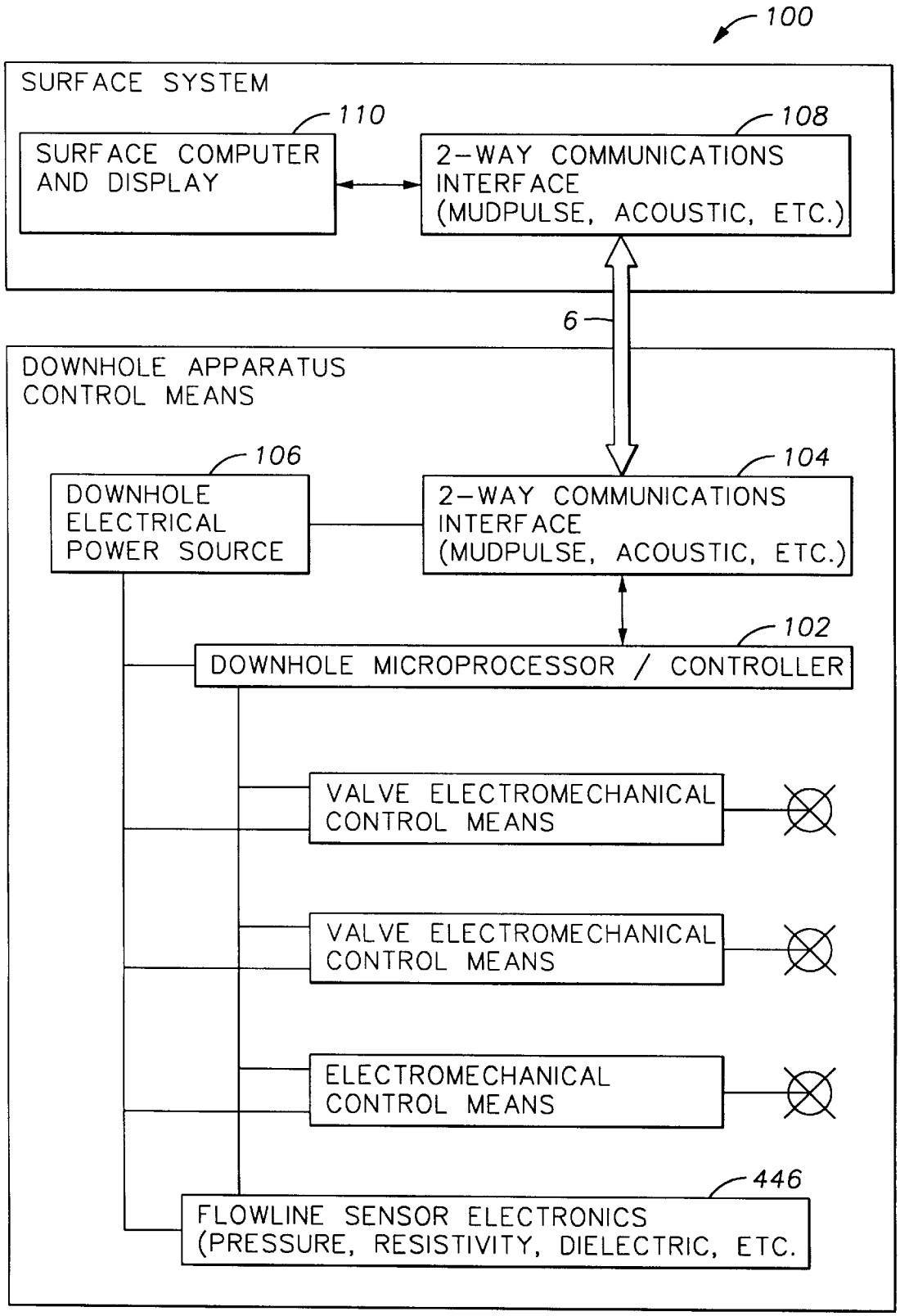
FIG. 8 is a schematic of the control system and the communication system which can be used in the present invention.

As depicted in FIG. 8, the invention includes use of a control system 100 for controlling the various valves and pumps, and for receiving the output of the sensor system 46. The control system 100 is capable of processing the sensor information with the downhole microprocessor/controller 102, and delivering the data to the communications interface 104, so that the processed data can then be telemetered to the surface using conventional technology. It should be noted that various forms of transmission energy could be used such as mud pulse, acoustical, optical, or electro-magnetic. The communications interface 104 can be powered by a downhole electrical power source 106. The power source 106 also powers the flow line sensor system 46, the microprocessor/controller 102, and the various valves and pumps.

Communication with the surface of the Earth can be effected via the work string 6 in the form of pressure pulses or other means, as is well known in the art. In the case of mud pulse generation, the pressure pulse will be received at the surface via the 2-way communication interface 108. The data thus received will be delivered to the surface computer 110 for interpretation and display.

Command signals may be sent down the fluid column by the communications interface 108, to be received by the downhole communications interface 104. The signals so received are delivered to the downhole microprocessor/controller 102. The controller 102 will then signal the appropriate valves and pumps for operation as desired.

The down hole microprocessor/controller 102 can also contain a pre-programmed sequence of steps based on pre-determined criteria. Therefore, as the down hole data, such as pressure, resistivity, flow rate, viscosity, density, or dielectric constants, are received, the microprocessor/controller would automatically send command signals via the control means to manipulate the various valves and pumps.

Figure 9:
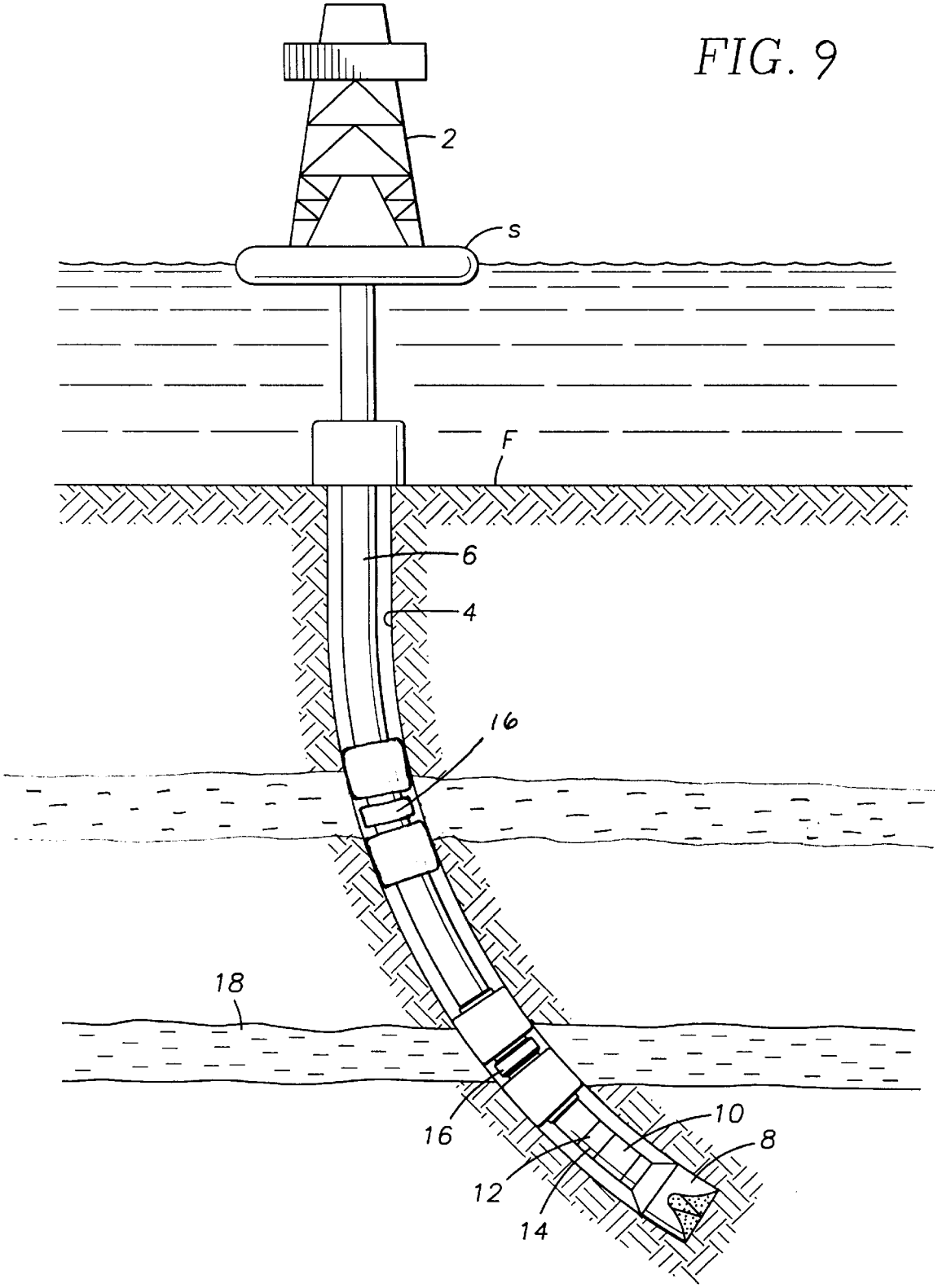
FIG. 9 is a partial section view of the apparatus of the present invention, showing more than two extendable elements.

As shown in FIG. 9, it can be useful to have two or more sets of extendable packers, with associated test apparatus 16 therebetween. One set of packers can isolate a first formation, while another set of packers can isolate a second formation. The apparatus can then tie used to pump formation fluid from the first formation into the second formation. This function can be performed either from one annulus 33 at the first formation to another annulus 33 at the second formation, using the extended packers for isolation of the formations. Alternatively, this function can be performed via sample fluid passageways 40A in the two sets of test apparatus 16, using the extended pistons 45 for isolation of the formations. For instance, referring again to FIG. 7, in the first set of test apparatus 16, the sample inlet valve 59 can be closed and the draw down valve 57 opened. With the pump inlet and outlet valves 120, 122 aligned as shown in FIG. 7, the pump 53 can be operated to pump formation fluid from the annulus 33 at the first formation into the return flow passageway 36. The return flow passageway 36 can extend through the work string 6 to the second set of test apparatus 16 at the second formation. There, the second sample inlet valve 59 can be closed and the second draw down valve 57 can be opened, just as in the first set of test apparatus 16. However, in the second set of test apparatus 16, the pump inlet and outlet valves 120, 122 can be rotated clockwise a quarter turn to allow the second pump 53 to pump the first formation fluid from the return flow passageway 36 into the second formation via the second draw down valve 57 and via the annulus 33. Variations of this process can be used to pump formation fluid from one or more formations into one or more other formations. At the lower end of the work string 6, it may only be necessary to have a single extendable packer for isolating the lower annulus.

Figure 10:
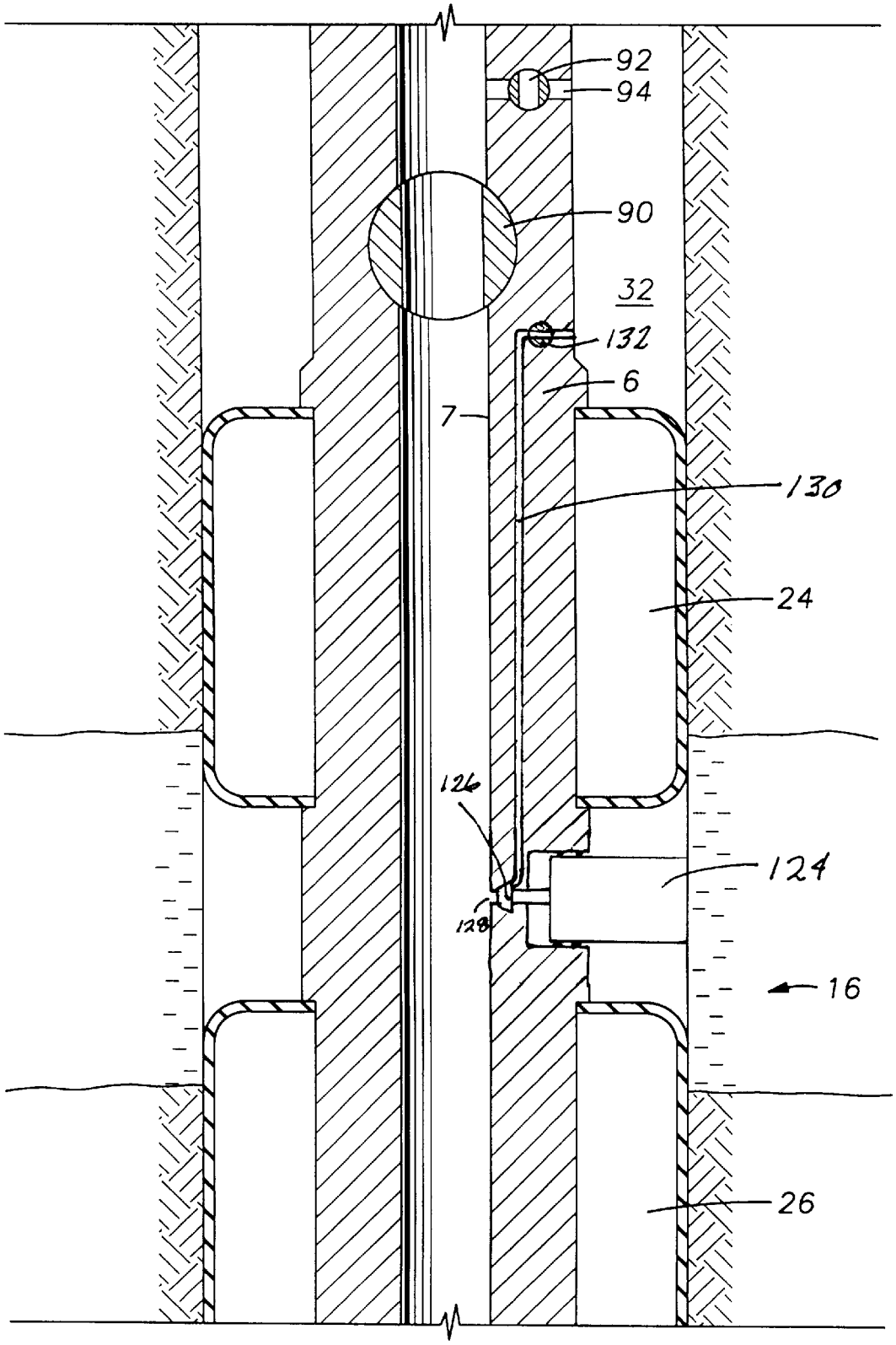
FIG. 10 is a section view of the apparatus of the present invention, showing one embodiment of a coring device.

As shown in FIG. 10, it can also be useful to incorporate a formation coring device 124 into the test apparatus 16 of the present invention. The coring device 124 can be extended into the formation by equipment identical to the equipment described above for extending the piston 45. The coring device 124 can be rotated by a turbine 126 which is activated by drilling fluid via the central bore 7 and a turbine inlet port 128. The outlet of the turbine 126 can be via an outlet passageway 130 and a turbine control valve 132, which is controlled by the control system 100. With the packers 24, 26 extended, the coring device 124 is extended and rotated to obtain a pristine core sample of the formation. The core sample can then be withdrawn into the work string 6, where some chemical analysis can be performed if desired, and the core sample can be preserved in its pristine state for extraction upon return of the test apparatus 16 to the surface.

OPERATION

In operation, the formation tester 16 is positioned adjacent a selected formation or reservoir. Next, a hydrostatic pressure is measured utilizing the pressure sensor located within the sensor system 46, as well as determining the drilling fluid resistivity at the formation. This is achieved by pumping fluid into the sample system 46, and then stopping to measure the pressure and resistivity. The data is processed down hole and then stored or transmitted up-hole using the MWD telemetry system.

Next, the operator expands and sets the inflatable packers 24, 26. This is done by maintaining the work string 6 stationary and circulating the drilling fluid down the inner bore 7, through the drill bit 8 and up the annulus. The valves 39 and 80 are open, and therefore, the return flow passageway 36 is open. The control valve 30 is positioned to align the high pressure passageway 27 with the inflation fluid passageways 28A, 28B, and drilling fluid is allowed to flow into the packers 24, 26. Because of the pressure drop from inside the inner bore 7 to the annulus across the drill bit 8, there is a significant pressure differential to expand the packers 24, 26 and provide a good seal. The higher the flow rate of the drilling fluid, the higher the pressure drop, and the higher the expansion force applied to the packers 24, 26. Alternatively, or in addition, another expandable element such as the piston 45 is extended to contact the wall of the well bore, by appropriate positioning of the control valve 30.

The upper packer element 24 can be wider than the lower packer 26, thereby containing more volume. Thus, the lower packer 26 will set first. This can prevent debris from being trapped between the packers 24, 26.

The venturi pump 38 can then be used to prevent overpressurization in the intermediate annulus 33, or the centrifugal pump 53 can be operated to remove the drilling fluid from the intermediate annulus 33. This is achieved by opening the draw down valve 41 in the embodiment shown in FIG. 3, or by opening the valves 82, 57, and 48 in the embodiment shown in FIG. 7.

If the fluid is pumped from the intermediate annulus 33, the resistivity and the dielectric constant of the fluid being drained can be constantly monitored by the sensor system 46. The data so measured can be processed down hole and transmitted up-hole via the telemetry system. The resistivity and dielectric constant of the fluid passing through will change from that of drilling fluid to that of drilling fluid filtrate, to that of the pristine formation fluid.

In order to perform the formation pressure build-up and draw down tests, the operator closes the pump inlet valve 57 and the by-pass valve 82. This stops drainage of the intermediate annulus 33 and immediately allows the pressure to build-up to virgin formation pressure. The operator may choose to continue circulation in order to telemeter the pressure results up-hole.

In order to take a sample of formation fluid, the operator could open the chamber inlet valve 58 so that the fluid in the passageway 40E is allowed to enter the sample chamber 56. Since the sample chamber 56 is empty and at atmospheric conditions, the baffle 72 will be urged downward until the chamber 56 is filled. An adjustable choke 74 is included for regulating the flow into the chamber 56. The purpose of the adjustable choke 74 is to control the change in pressure across the packers when the sample chamber is opened. If the choke 74 were not present, the packer seal might be lost due to the sudden change in pressure created by opening the sample chamber inlet valve 58.

Once the sample chamber 56 is filled, then the valve 58 can again be closed, allowing for another pressure build-up, which is monitored by the pressure sensor. If desired, multiple pressure build-up tests can be performed by repeatedly pumping down the intermediate annulus 33, or by repeatedly filling additional sample chambers. Formation permeability may be calculated by later analyzing the pressure versus time data, such as by a Horner Plot which is well known in the art. Of course, in accordance with the teachings of the present invention, the data may be analyzed before the packers 24 and 26 are deflated. The sample chamber 56 could be used in order to obtain a fixed, controlled drawn down volume. The volume of fluid drawn may also be obtained from a down hole turbine meter placed in the appropriate passageway.

Once the operator is prepared to either drill ahead, or alternatively, to test another reservoir, the packers 24, 26 can be deflated and withdrawn, thereby returning the test apparatus 16 to a standby mode. If used, the piston 45 can be withdrawn. The packers 24, 26 can be deflated by positioning the control valve 30 to align the low pressure passageway 31 with the inflation passageway 28. The piston 45 can be withdrawn by positioning the control valve 30 to align the low pressure passageway 31 with the cylinder passageway 29. However, in order to totally empty the packers or the cylinder, the venturi pump 38 or the centrifugal pump 53 can be used.

Once at the surface, the sample chamber 56 can be separated from the work string 6. In order to drain the sample chamber, a container for holding the sample (which is still at formation pressure) is attached to the outlet of the chamber outlet valve 62. A source of compressed air is attached to the expulsion valve 60. Upon opening the outlet valve 62, the internal pressure is released, but the sample is still in the sample chamber. The compressed air attached to the expulsion valve 60 pushes the baffle 72 toward the outlet valve 62, forcing the sample out of the sample chamber 56. The sample chamber may be cleaned by refilling with water or solvent through the outlet valve 62, and cycling the baffle 72 with compressed air via the expulsion valve 60. The fluid can then be analyzed for hydrocarbon number distribution, bubble point pressure, or other properties.

Once the operator decides to adjust the drilling fluid density, the method comprises the steps of measuring the hydrostatic pressure of the well bore at the target formation. Then, the packers 24, 26 are set so that an upper 32, a lower 34, and an intermediate annulus 33 are formed within the well bore. Next, the well bore fluid is withdrawn from the intermediate annulus 33 as has been previously described and the pressure of the formation is measured within the intermediate annulus 32. The other embodiments of extendable elements may also be used to determine formation pressure.

The method further includes the steps of adjusting the density of the drilling fluid according to the pressure readings of the formation so that the mud weight of the drilling fluid closely matches the pressure gradient of the formation. This allows for maximum drilling efficiency. Next, the inflatable packers 24, 26 are deflated as has been previously explained and drilling is resumed with the optimum density drilling fluid.

The operator would continue drilling to a second subterranean horizon, and at the appropriate horizon, would then take another hydrostatic pressure measurement, thereafter inflating the packers 24, 26 and draining the intermediate annulus 33, as previously set out. According to the pressure measurement, the density of the drilling fluid may be adjusted again and the inflatable packers 24, 26 are unseated and the drilling of the bore hole may resume at the correct overbalance weight.

The invention herein described can also be used as a near bit blow-out preventor. If an underground blow-out were to occur, the operator would set the inflatable packers 24, 26, and have the valve 39 in the closed position, and begin circulating the drilling fluid down the work string through the open valves 80 and 82. Note that in a blowout prevention application, the pressure in the lower annulus 34 may be monitored by opening valves 39 and 48 and closing valves 57, 59, 30, 82, and 80. The pressure in the upper annulus may be monitored while circulating directly to the annulus through the bypass valve by opening valve 48. Also the pressure in the internal diameter 7 of the drill string nay be monitored during normal drilling by closing both the inlet valve 39 and outlet valve 80 in the passageway 36, and opening the by-pass valve 82, with all other valves closed. Finally, the by-pass passageway 84 would allow the operator to circulate heavier density fluid in order to control the kick.

Alternatively, if the embodiment shown in FIG. 6 is used, the operator would set the first and second inflatable packers 24, 26 and then position the circulation valve 90 in the closed position. The inflatable packers 24, 26 are set at a position that is above the influx zone so that the influx zone is isolated. The shunt valve 92 contained on the work string 6 is placed in the open position. Additives can then be added to the drilling fluid at the surface, thereby increasing the density. The heavier drilling fluid is circulated down the work string 6, through the shunt valve 92. Once the denser drilling fluid has replaced the lighter fluid, the inflatable packers 24, 26 can be unseated and the circulation valve 90 is placed in the open position. Drilling may then resume.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. An apparatus for testing an underground formation during drilling operations, comprising:

a rotatable drill string;

at least one extendable element mounted on said drill string, said at least one extendable element being selectively extendable into sealing engagement with the wall of the well bore for isolating a portion of the well bore at the formation while rotation of the drill string is stopped, said at least one extendable element being selectively retractable;

a test port in said drill string, said test port being exposable to said isolated portion of the well bore; and a test device mounted within said drill string for testing at least one characteristic of the formation via said test port.

2. The apparatus recited in claim 1, wherein said test device comprises:

a fluid control device mounted within said drill string for allowing formation fluid through said test port from said isolated portion of the well bore; and a sensor for sensing at least one characteristic of the fluid.

3. The apparatus recited in claim 2, wherein said sensor comprises a pressure sensor.

4. The apparatus recited in claim 2, wherein said sensor comprises a resistivity sensor.

5. The apparatus recited in claim 2, wherein said sensor comprises a viscosity senor.

6. The apparatus recited in claim 2, wherein said sensor comprises a flow rate measuring device.

7. The apparatus recited in claim 2, wherein said sensor comprises a dielectric property measuring device.

8. The apparatus recited in claim 2, wherein said sensor comprises a density measuring device.

9. The apparatus recited in claim 2, wherein said sensor comprises an optical spectroscope.

10. The apparatus recited in claim 2, further comprising at least one sample chamber mounted on said drill string, said at least one sample chamber being in fluid flow communication with said test port, for collecting a sample of formation fluid.

11. The apparatus recited in claim 10, wherein said at least one sample chamber is wireline retrievable.

12. The apparatus recited in claim 1, wherein said test device comprises a coring device mounted within said drill string for obtaining a core sample from said isolated portion of the formation through said test port.

13. The apparatus recited in claim 1, wherein said at least one extendable element comprises first and second expandable annular elements mounted on said drill string, said second expandable annular element being spaced longitudinally from said first expandable annular element, said first and second expandable annular elements being selectively expandable to contact the wall of the well bore in a sealing relationship, thereby dividing an annular space surrounding said drill string into an upper annulus, an intermediate annulus and a lower annulus, wherein said intermediate annulus comprises said isolated portion of the well bore.

14. The apparatus recited in claim 13, further comprising:

at least a third additional expandable annular element mounted on said drill string, each said expandable annular element being spaced longitudinally from other said expandable annular elements, said expandable annular elements being selectively expandable to contact the wall of the well bore in a sealing relationship, thereby dividing an annular space surrounding said drill string into a longitudinally arranged series of annular spaces, wherein said series of annular spaces comprise a series of isolated portions of the well bore; and at least a second additional test port in said drill string, each said test port being exposable to a respective said isolated portion of the well bore.

15. The apparatus recited in claim 14, wherein said expandable annular elements comprise expandable packers.

16. The apparatus recited in claim 1, further comprising a protective structure on said drill string, said protective structure extending radially beyond said at least one extendable element, when said element is retracted.

17. The apparatus recited in claim 16, wherein said protective structure comprises at least one rigid stabilizer element on said drill string adjacent said at least one extendable element, said rigid stabilizer element extending radially beyond the outermost extremity of said at least one extendable element when said at least one extendable element is retracted.

18. The apparatus recited in claim 1, wherein said test port is located in said extendable element.

19. The apparatus recited in claim 1, wherein said test port is located adjacent to said extendable element.

20. A method of testing a formation comprising:

lowering a drill string into a well bore, said drill string including a drill bit, a telemetry system, at least one element extendable from said drill string, a test port, and at least one formation test device;

drilling the well bore hole;

positioning said at least one extendable element adjacent a selected subterranean formation;

extending said at least one extendable element into sealing engagement with the wall of the well bore to isolate a portion of the well bore adjacent the selected formation; and performing a test of said formation via said test port.

21. The method recited in claim 20, wherein said formation test device includes a fluid control device and a sensing apparatus, and said step of performing a test of said formation comprises:

allowing formation fluid through said test port from said isolated portion of the well bore; and sensing at least one characteristic of the formation fluid.

22. The method recited in claim 21, wherein said drill string further includes at least one sample chamber, said method further comprising transferring formation fluid into said at least one sample chamber.

23. The method recited in claim 21, further comprising telemetering information about said at least one characteristic.

24. The method recited in claim 20, wherein said formation test device includes a coring device, and said step of performing a test of said formation comprises obtaining a core sample from said isolated portion of the formation, through said test port.

25. A method of testing a formation comprising:

lowering a drill string into a well bore, said drill string including a drill bit, at least one element extendable from said drill string, a port, and at least one fluid transfer device;

drilling the well bore hole;

positioning said at least one extendable element adjacent a selected subterranean formation;

extending said at least one extendable element into sealing engagement with the wall of the well bore to isolate a portion of the well bore adjacent the selected formation; and applying high pressure fluid via said port with said fluid transfer device, to fracture said isolated portion of the well bore.

26. A method of testing a formation comprising:

lowering a drill string into a well bore, said drill string including a drill bit, at least one element extendable from said drill string, a port, at least one fluid transfer device and a pressure sensing apparatus;

drilling the well bore hole;

positioning said at least one extendable element adjacent a selected subterranean formation;

extending said at least one extendable element into sealing engagement with the wall of the well bore to isolate a portion of the well bore adjacent the selected formation;

applying fluid via said port with said fluid transfer device, to raise the pressure in said isolated portion of the well bore to a selected test level; and monitoring the pressure in said isolated portion of the well bore with said pressure sensing apparatus to sense a pressure drop.

27. A method of testing a formation comprising:

lowering a drill string into a well bore, said drill string including a drill bit, at least two elements expandable from said drill string, at least two ports, and at least one fluid transfer device;

drilling the well bore hole;

positioning said at least two expandable elements adjacent to at least two selected subterranean formations;

expanding said at least two expandable elements into sealing engagement with the wall of the well bore to isolate said at least two selected subterranean formations from each other; and transferring formation fluid from at least a first said selected subterranean formation to at least a second said selected subterranean formation through said at least two ports.

* * * * *